US005540068A

United States Patent [19]

Gartner et al.

[11] Patent Number: 5,540,068

[45] **Date of Patent: * Jul. 30, 1996**

[54] HIGH SECURITY ELECTRONIC DIAL COMBINATION LOCK

[75] Inventors: Klaus W. Gartner, Palos Verdes Estates; Larry I. Cutter, Torrance; Peter I. Phillips, Lake Arrowhead, all of Calif.

[73] Assignee: La Gard, Inc., Torrance, Calif.

[ * ] Notice: The portion of the term of this patent subsequent to May 3, 2011, has been disclaimed.

[21] Appl. No.: 237,258

[22] Filed: May 2, 1994

Related U.S. Application Data

[63] Continuation of Ser. No. 629,119, Dec. 17, 1990, Pat. No. 5,307,656.

[51] Int. Cl.[6] ..... E05B 47/00

[52] U.S. Cl. ..... 70/277; 70/278; 70/303 A; 70/322

[58] Field of Search ..... 70/277, 278, 303 A, 70/303 R, 301, 302, 133, 321, 322

[56] References Cited

U.S. PATENT DOCUMENTS

| | | | |
|---|---|---|---|
| 686,073 | 11/1901 | Hollar et al. | 70/278 |
| 1,353,257 | 9/1920 | Mample | 70/278 |
| 1,867,001 | 7/1932 | Diesel | 70/303 A X |
| 2,079,702 | 5/1937 | Diesel | 70/269 |
| 2,775,114 | 12/1956 | Lee | 70/133 |
| 2,925,726 | 2/1960 | Miller | 70/303 A |
| 3,045,466 | 7/1962 | Herlong | 70/303 |
| 3,339,382 | 9/1967 | Miller et al. | 70/23 |
| 3,376,721 | 4/1968 | Levine | 70/277 |
| 3,559,430 | 2/1971 | Waller | 70/277 |
| 3,702,070 | 11/1972 | Gartner | 70/278 |
| 3,702,551 | 11/1972 | Blizard | 70/269 |
| 3,758,734 | 9/1973 | Gartner | 200/5 R |
| 3,968,667 | 7/1976 | Gartner et al. | 70/303 A |
| 3,980,844 | 9/1976 | Bianco | 200/43 |
| 3,981,167 | 9/1976 | Phillips | 70/311 |
| 3,991,596 | 11/1976 | Gartner | 70/303 A |
| 4,038,846 | 8/1977 | Klann | 70/220 |
| 4,106,316 | 8/1978 | Tippin | 70/268 |
| 4,142,388 | 3/1979 | Phillips et al. | 70/316 |
| 4,148,092 | 4/1979 | Martin | 361/172 |
| 4,328,689 | 5/1982 | Keller et al. | 70/303 |
| 4,532,785 | 8/1985 | Uyeda | 70/333 |
| 4,541,259 | 9/1985 | Uyeda | 70/316 |
| 4,628,715 | 12/1986 | Uyeda et al. | 70/333 |
| 4,745,784 | 5/1988 | Gartner | 70/277 |
| 4,754,629 | 7/1988 | Allen | 70/333 R |
| 4,756,176 | 7/1988 | Uyeda | 70/303 A |
| 4,774,512 | 9/1988 | Jolidon et al. | 70/284 |
| 4,831,851 | 5/1989 | Larson | 70/303 |
| 4,904,984 | 2/1990 | Gartner et al. | 70/333 R X |
| 4,910,981 | 3/1990 | Gartner | 70/314 |
| 4,967,577 | 11/1990 | Gartner et al. | 70/279 |

FOREIGN PATENT DOCUMENTS

| | | | |
|---|---|---|---|
| 159448 | 10/1954 | Australia | 70/303 A |
| 213237-A | 3/1987 | European Pat. Off. | 70/455 |
| 3817696-C | 11/1989 | Germany | 70/277 |

*Primary Examiner*—Lloyd A. Gall
*Attorney, Agent, or Firm*—Poms, Smith, Lande & Rose Professional Corporation

[57] ABSTRACT

An electronic combination lock is disclosed which allows access to a closed or secure location wherein the lock includes a locking mechanism for operating between a locked condition and an unlocked condition. A rotatable cam wheel has a circumferential surface portion defining a slot such that rotation of the cam wheel moves the slot. A movable lever is coupled to the locking mechanism for changing the condition of the locking mechanism from the locked condition to the unlocked condition and is pivotably movable into and out of engagement with the cam wheel. The movable lever engages the cam wheel such that rotation of the cam wheel changes the condition of the locking mechanism. A cantilever and detent on the lever releasably maintain the lever in a position disengaged from the cam wheel. A solenoid and projectable detent moves the lever from its disengaged position for engaging the lever with the cam wheel so that rotation of the cam wheel changes the locking mechanism from the locked condition to the unlocked condition.

41 Claims, 4 Drawing Sheets

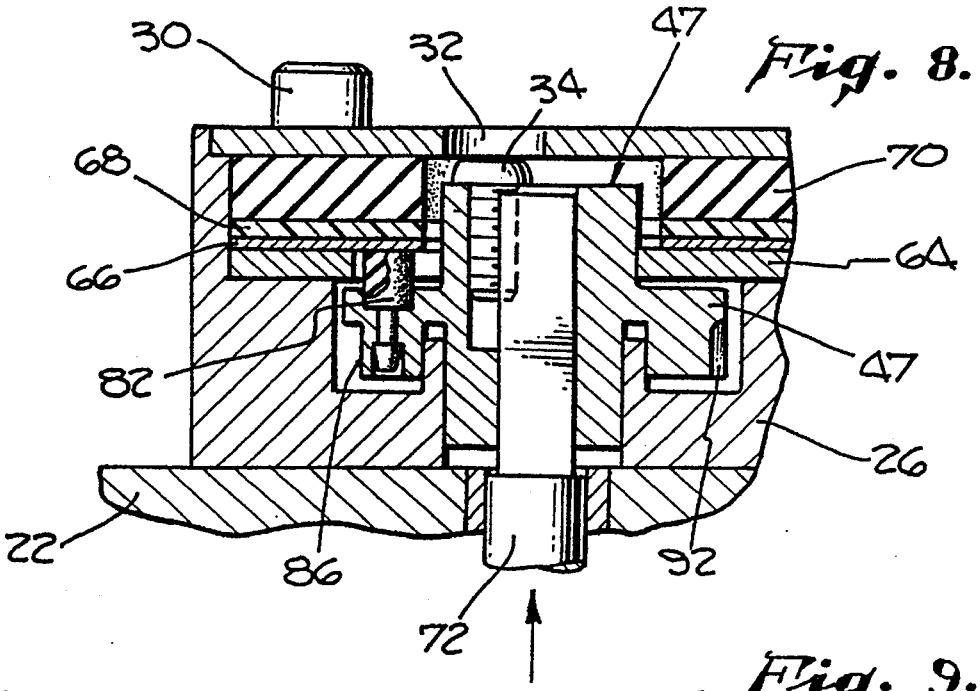
Fig. 8.
Fig. 10.
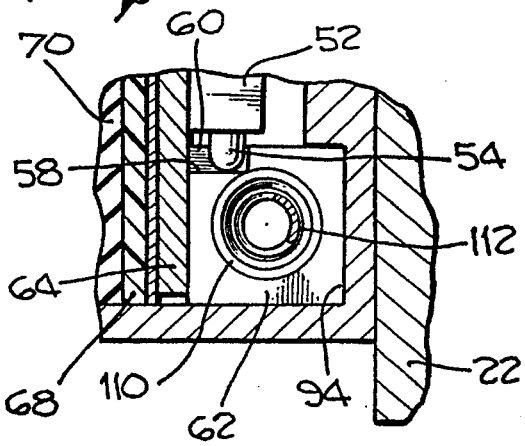
Fig. 9.
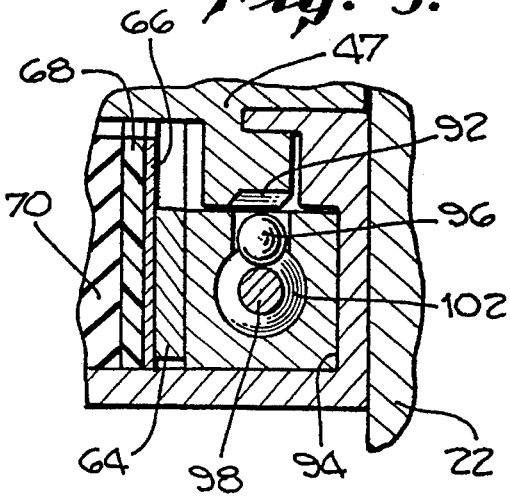
Fig. 11.
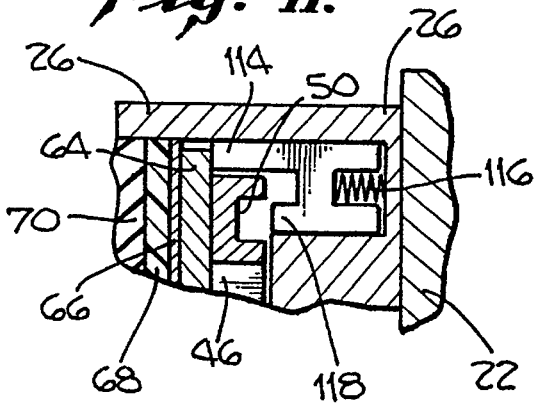
Fig. 12.
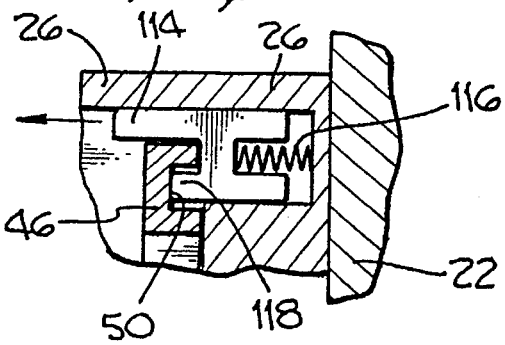

HIGH SECURITY ELECTRONIC DIAL COMBINATION LOCK

CROSS REFERENCE TO RELATED APPLICATIONS

This application is a continuation of application Ser. No. 07/629,119 filed Dec. 17, 1990, now U.S. Pat. No. 5,307,656, which issued on May 3, 1994.

BACKGROUND OF THE INVENTION

1. Field of the Invention

This invention relates generally to electronic dial combination locks having improved tamper resistance, and more specifically to such locks wherein a locking mechanism is opened by rotation of the dial.

2. Description of the Related Art

Electronic dial combination locks allow authorized personnel to access otherwise inaccessible security regions such as safes, lock boxes, storage rooms and the like. One such class of lock is the electronic dial combination lock which uses a dial having divisions to enter a combination code to gain entrance to the secured area. The lock has a spindle journaled within the lock for both rotational and axial movement to cause a push pin located on an internal cam wheel to engage one of a plurality of pressure-sensitive switches within the lock located in an evenly-spaced circular pattern centered on the shaft's axis, each switch being capable of making a discrete, unique electrical connection. A circuit contained in the secured region senses the electrical connections and detects when a given subset of connections has been made corresponding to the lock's combination and initiates an electrical signal within the secured region. The signal may be used, e.g., to operate a solenoid to permit a conventional fence lever to engage the cam wheel such that a bolt within the lock may be withdrawn, such as in a safe door. Such a lock is shown and described in U.S. Pat. No. 4,745,784. In the lock of that patent, when the correct combination is entered, the solenoid releases a fence lever so that a nose part formed thereon falls by gravity onto the circumferential surface of a cam wheel. The cam wheel is rotated by the combination dial until the nose part on the fence lever engages the slot in the circumference of the cam wheel to allow withdrawal of the bolt in the locking mechanism.

It has been recognized heretofore that it would be desirable to have a positive drive of the fence toward the tumbler wheel gates and the lever nose toward its cam wheel slot to ensure operation of the lever on entry of the combination. Generally these locks have employed a cam mechanism operated off of dial rotation to drive its fence lever toward the wheel once on each rotation of the dial. Such a lock is illustrated in U.S. Pat. No. 4,910,981. However, there is the possibility of learning something about the lock's internal parts from such regular impacting of the wheel by this fence or unauthorized manipulation of the lock by lock experts.

There is thus a need for a dial combination lock which does not allow an unauthorized user to obtain information about the characteristics of the gate tumbler wheels or the slotted cam wheel through manipulation of the combination dial and fence lever. Additionally, there is a need for a combination lock which prevents engagement of the fence lever with the tumbler wheels or the cam wheel until such time as the correct combination has been dialed into the lock mechanism and the nose part on the lever is aligned with the slot on the cam wheel. There is also a need for a combination lock which provides for positive movement of the lever into engagement with the slot in the cam wheel upon alignment through rotation of the combination dial.

SUMMARY OF THE INVENTION

The present invention provides a high security electronic dial combination lock which provides improved means for minimizing tampering, and for providing more predictable operation of the lock by positively engaging the fence lever with the cam wheel when the nose part on the fence lever and the slot in the cam wheel are properly aligned.

These and other objects of the present invention are accomplished preferably in an electronic combination lock which allows access to a closed or secure location wherein the lock includes a locking mechanism for operating between a locked condition and an unlocked condition. A rotatable cam wheel has a circumferential surface portion defining a slot such that rotation of the cam wheel moves the slot. A movable lever is coupled to the locking mechanism for changing the condition of the locking mechanism from the locked condition to the unlocked condition and is pivotably movable into and out of engagement with the cam wheel. The movable lever engages the cam wheel such that rotation of the cam wheel changes the condition of the locking mechanism. Means are included for releasably maintaining the pivotable lever in a position substantially disengaged from the cam wheel. Means are also included of removing the lever from its disengaged position for engaging the lever with the cam wheel so that rotation of the cam wheel changes the locking mechanism from the locked condition to the unlocked condition.

With the lock described herein, the lever is maintained in the disengaged position until the proper code is received by the lock. This serves the distinct purposes of ensuring that the lever does not engage the cam wheel until such time as the proper code has been entered and also that the lever is properly aligned with the cam wheel to allow proper engagement therebetween. Therefore, contact between the lever and the cam wheel cannot be used to obtain information about the characteristics of the cam wheel simply by rotating the combination dial. The means for moving the lever from its disengaged position to engage the cam wheel provides positive movement of the lever for engaging the cam wheel so that engagement between the fence lever and the cam wheel is not dependent on the force of gravity.

In a preferred embodiment, a solenoid is activated upon entry of the proper combination code for moving a detent into position to be contacted by a boss on the cam wheel. Upon contact with the detent, further rotation of the cam wheel moves the entire solenoid housing which in turn moves a cantilevered portion of the lever so that a nose part on the lever properly engages the slot on the cam wheel. The combination of the boss on the cam wheel, the configuration of the solenoid housing and the cantilevered portion of the lever are such that the slot in the cam wheel and the nose part on the lever are properly aligned when the lever is moved into contact with the cam wheel.

A relock may be included to hold the lever in its disengaged position even after the solenoid or other parts of the lock are disabled or otherwise affected such as by tampering. In such a case, the locking mechanism thereafter cannot be moved into the unlocked condition.

Skilled practitioners will obtain a more complete understanding of the present invention from a review of the following detailed description of a preferred embodiment, in conjunction with the drawings, of which the following is a brief description.

BRIEF DESCRIPTION OF THE DRAWINGS

FIG. 8 is a rear sectional view of a portion of the lock showing one of the steps in the entry of a combination code.

FIG. 9 is a side sectional view of a portion of the lock taken along the section line 9—9 of FIG. 5 showing the solenoid and a portion of the cam wheel.

FIG. 10 is a side sectional view of a portion of the lock taken along the section line 10—10 of FIG. 5 showing the solenoid and a detent on the lever received in a recess.

FIG. 11 is a detailed side section of a portion of the lock of FIG. 1 taken along the section line 11—11 showing a relock mechanism.

FIG. 12 is a side section similar to FIG. 11 showing the relock engaging the fence lever.

DETAILED DESCRIPTION OF THE PREFERRED EMBODIMENTS

Figure 1:
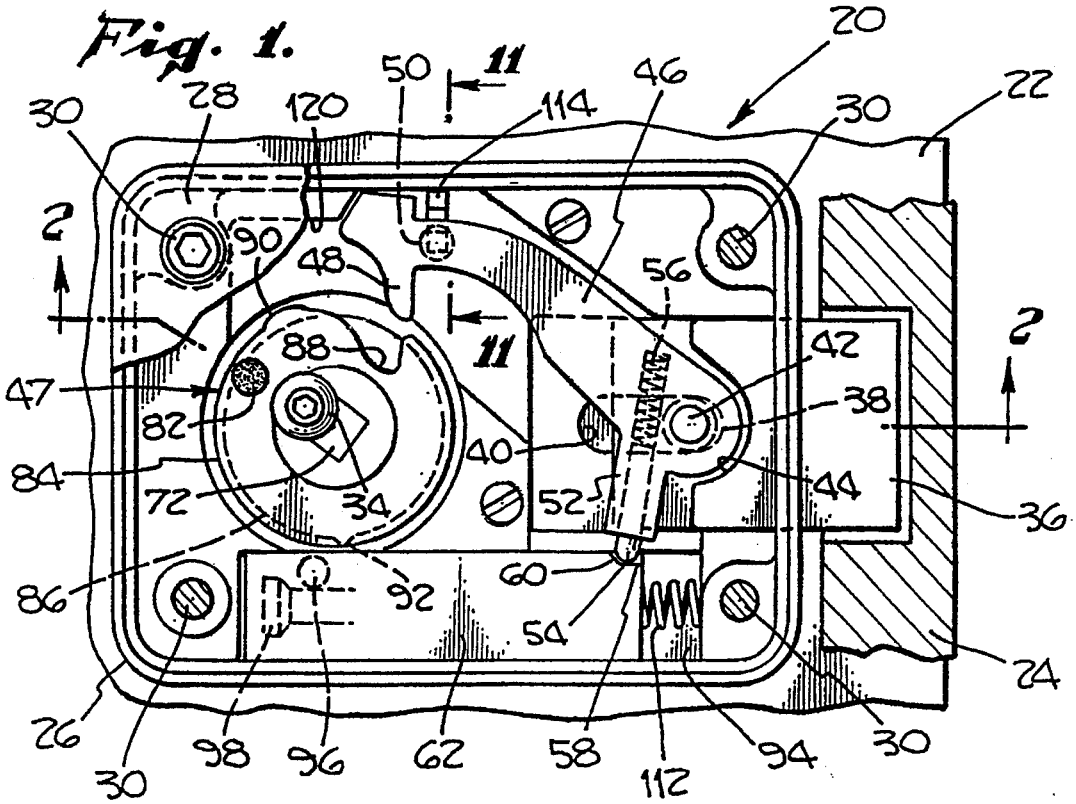
FIG. 1 is a rear partial sectional view of the lock according to the preferred embodiment of the present invention mounted to a frame element and showing a locking mechanism in a locked condition.

An exemplary embodiment of the preferred electronic dial combination lock 20 (FIG. 1 and 2) in accordance with the present invention provides a high security lock which minimizes successful tampering, and provides positive engagement of a lever with a cam wheel when a protrusion on the lever is properly aligned with a slot on the cam wheel. The lock is preferably mounted on the inside surface of a door 22 or other frame element defining in part the closed or secured location protecting the secured area, such as the contents of a safe. The lock 20 keeps the door closed and locked against a frame element 24, which may be, for example, a safe enclosure.

The lock 20 is contained substantially within a housing 26 mounted on the rear or inside surface of the door 22 by conventional fastening means, such a screws and bosses. A cover plate 28 closes the lock housing and is mounted thereto through bolts 30 in a conventional manner. The cover plate includes an aperture 32 permitting access to a bolt 34.

Figure 2:
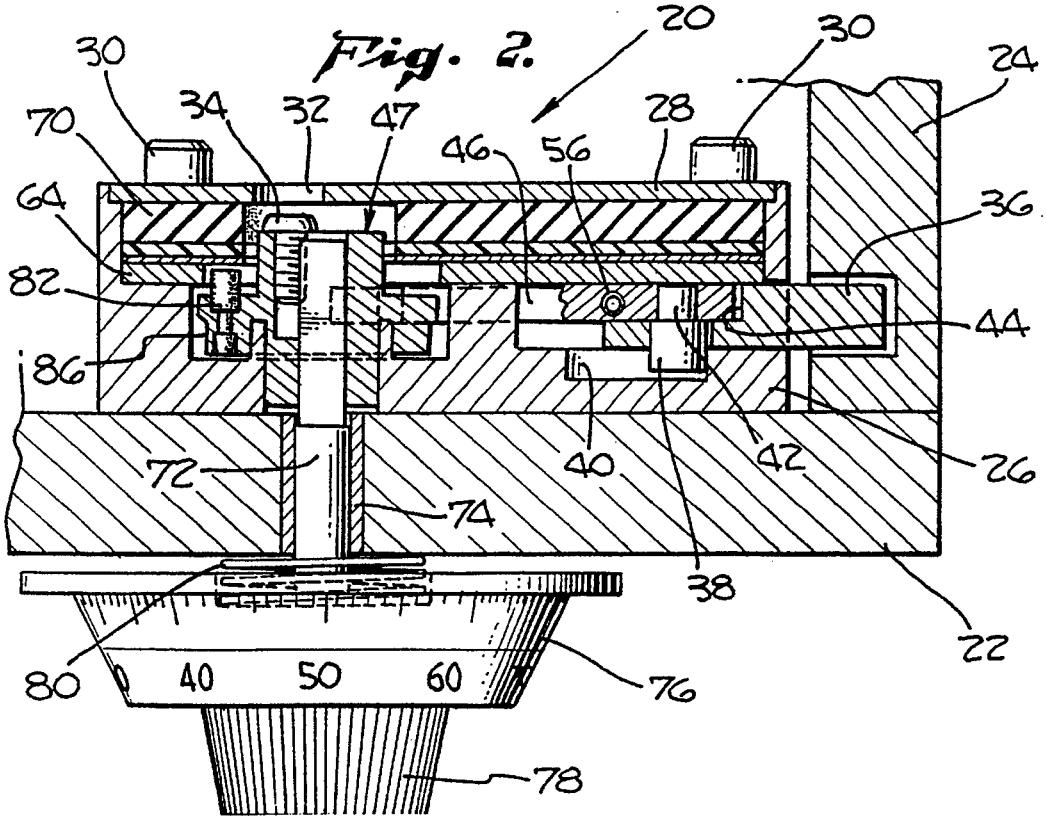
FIG. 2 is a bottom sectional view of the lock and frame element taken along the section line 2—2 shown in FIG. 1.
Figure 4:
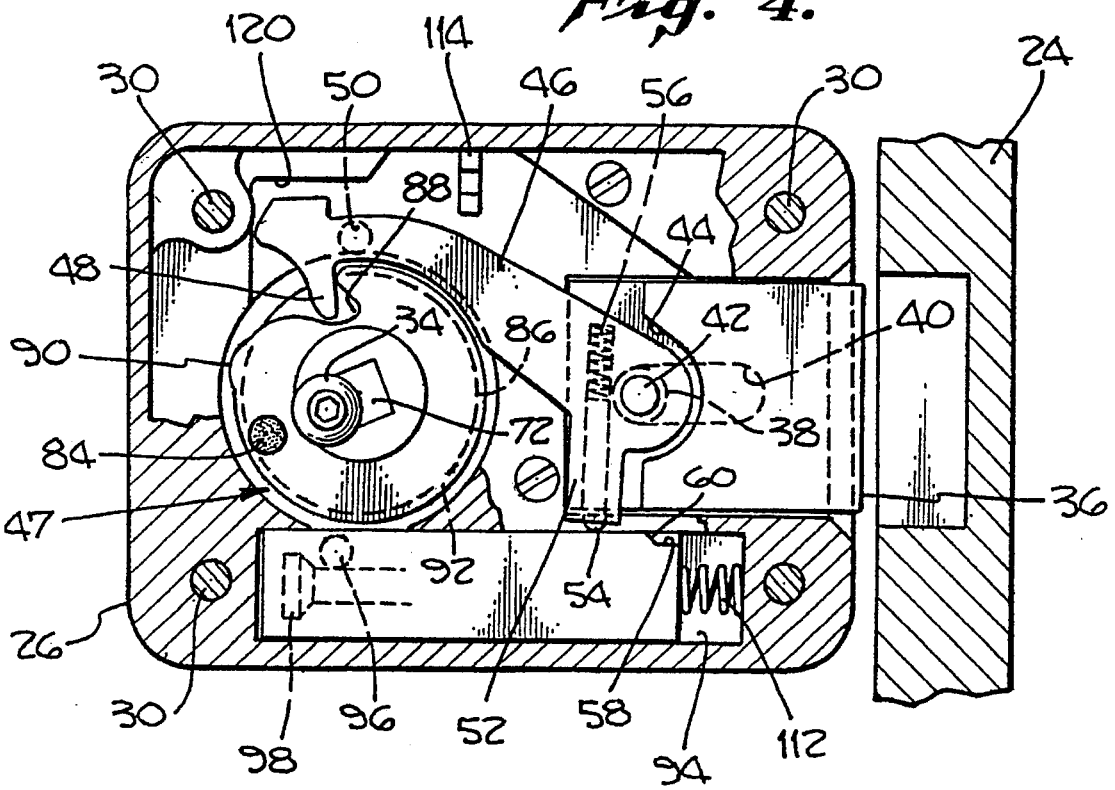
FIG. 4 is a rear sectional view of the lock of FIG. 1 showing a cam wheel rotated to longitudinally displace the lever and retract the bolt.

A locking mechanism in the form of a bolt 36 is slidably retained in the housing 26 to slide between a lock condition or position shown in FIGS. 1 and 2 and an unlocked condition or position (FIG. 4). The bolt slides in an opening in the side of the housing 26 into and out of a receptacle in the frame element 24. A pin 38 journaled through a portion of the bolt, interior to the housing 26, moves in a short track defined by a groove 40 formed in the base of the housing to limit the travel of the bolt between the locked position and the unlocked position. The pin has a reduced diameter portion 42 which extends to the side of the bolt opposite the groove 40 and into a milled out area 44 of the bolt.

A lever 46 is pivotably coupled to the bolt through the reduced diameter portion 42 of the pin 38 for controlling the movement of the bolt 36 from the locked position to the unlocked position. Longitudinal movement of the lever within the housing moves the bolt, while rotational movement allows the lever to engage a cam wheel 47, as described more fully below. The lever extends from the pivot point at the pin 38 along a neck portion within the lock housing to a protrusion or nose part 48 for engaging the cam wheel 47. The neck of the lever between the nose part and the pivot point includes a relock recess 50 formed in that side of the lever which is adjacent the housing, i.e., closest to the door 22, for receiving the pin of a relock mechanism (described more fully below in conjunction with FIGS. 11 and 12).

The lever 46 includes a projection or blocking element in the form of a cantilever arm 52 for retaining or holding the lever 46 stationary and out of engagement with the cam wheel 47 when the cantilever arm is stationary and for pivoting the lever arm about the pivot point whenever the end of the cantilever arm is moved. The cantilever arm preferably extends from a portion of the lever close to the pivot point between the pivot pint and the nose part 48. The cantilever arm includes a bore containing a detent pin 54 biased outwardly of the bore by a spring 56 so that the detent pin engages a recess 58 to block movement of the lever 46. The recess has a ramp surface 60 and is formed, in the preferred embodiment, integral with one end of a solenoid housing 62 (described more fully below). When the recess 58 is maintained in the position shown in FIG. 1, the lever is maintained in a position disengaged from the cam wheel for any rotational position of the cam wheel. Therefore, rotation of the cam wheel while the lever is in the disengaged position will not reveal any information about the configuration of the cam wheel or about the lever position. It should be noted that the recess 58 need not be integral with the solenoid housing but may be formed in a separate movable element which, when stationary, will maintain the lever 46 in a disengaged position from the cam wheel 47 for any rotational position of the cam wheel. As can be seen in FIG. 1, the relative angular position of the cantilever arm is preferably less than 180 degrees but more than 90 degrees from the neck portion of the lever.

The bolt 36 and the lever 46 are sandwiched between the housing 26 and a metal retaining plate 64. An opening in the metal plate accommodates rotation of the cam wheel 47, including the rubber finger used for entering the key code combination. A fish paper gasket 66 overlays the metal retaining plate and is coextensive with a printed circuit board 68 so that an appropriate combination code can be entered and received by the printed circuit board and processed in a manner such as that described in U.S. Pat. No. 4,745,784. The circuits on the printed circuit board are powered by a suitable power source (not shown), such as a replaceable battery as is well known to one skilled in the art. The printed circuit board is held in place by a rubber gasket 70 covered by the cover plate 28. Holes are formed in the fish paper gasket 66, the printed circuit board 68 and the rubber gasket 70 to allow free rotation of the cam wheel and the bolt 34.

A shaft or spindle 72 passes through the front of the housing 26 and through a sleeve 74 in the door 22 to extend outwardly of the secured area such that an external shaft end is accessible from outside the secured area while an internal end is within the lock housing. The shaft 72 is journaled within the housing for both rotational and axial movement relative to the housing and the printed circuit board 68. A dial 76 of well-known configuration is mounted to the external end of the shaft and includes a knurled knob 78 for both rotating and axially moving the dial, and therefore the shaft. A spring 80 between the door 22 and a recess in the dial biases the dial and shaft outwardly relative to the lock housing 26.

The portion of the shaft 72 passing through the door 22 is round to permit smooth and reliable rotation of the dial and cam during manipulation of the dial. That portion of the shaft internal to housing 26 and extending a relatively short distance into the door 22 has preferably a square cross-section so that rotation of the shaft through the dial 76 rotates the cam wheel 47. The cam wheel 47 is mounted to the square portion of the shaft 72 for coaxial rotation and axial displacement of the cam wheel whenever the shaft is rotated or moved axially. The bolt 34 fixes the cam wheel on the shaft 72. A rubber combination finger 82 is fixed in the cam wheel at an angular position corresponding to one discreet dial and shaft position and at a given radial position relative to the axis of the shaft so as to allow entering of the combination code through appropriate rotation and axial movement of the cam wheel, as described more fully in U.S. Pat. No. 4,745,784.

The cam wheel 47 has two circumferential operating surfaces, located axially on the cam wheel adjacent one another. The rear-most operating surface of the cam wheel is located in the same plane as the nose part 48 of the lever 46 and will be termed the lever cam surface 84. The axially next adjacent cam surface will be termed the driving surface or solenoid cam surface 86 for moving the solenoid housing, as described more fully below. The lever cam surface 84 includes a gate or slot 88 to accept the nose part 48 of the lever such that upon rotation of the cam wheel by the dial 76 in the proper direction, the lever retracts the bolt 36 to unlock the lock. The lever cam surface also includes a slight outward bulge in the form of a lever lift cam 90 positioned, on the lever cam surface, counterclockwise from the slot 88, as viewed in FIG. 1 from the back of the lock, to insure that the nose part 48 of the lever is properly spaced from the cam wheel 47 when the locking mechanism is moved to the locked position.

The solenoid cam surface 86 is generally circular in outline having a normal diameter less than the normal diameter of the lever cam surface 84. The solenoid cam surface includes a small sloped protrusion or boss 92 extending radially outwardly of the solenoid cam surface and extending axially across substantially the entire solenoid cam surface 86 for engaging and pushing an extended detent in the solenoid housing 62 upon rotation of the cam wheel. The point of the boss 92 extends approximately to the same maximum radius as the maximum radius of the adjacent portion of the lever cam surface 84.

The solenoid housing 62 is a rigid body or element, preferably brass, movable in a channel 94 (FIGS. 3 and 4) for positively operating, driving or moving the lever from its disengaged position to a position for engaging the nose part 48 on the lever 46 with the slot 88 on the cam wheel 47 in response to dial 76 rotation after the combination code has been entered so that rotation of the cam wheel in a given direction changes the locking mechanism from the locked position (FIG. 3) to the unlocked position (FIG. 4).

Figure 5:
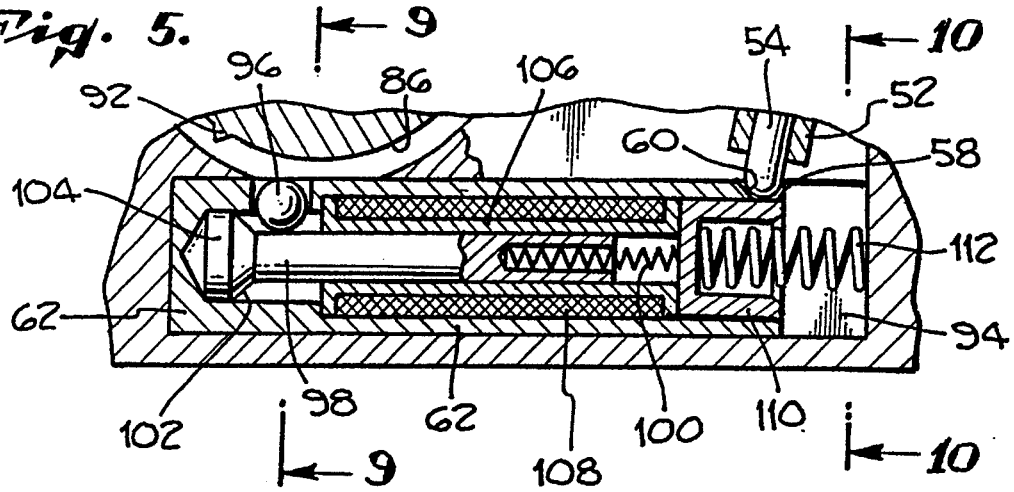
FIG. 5 is a detailed sectional view of a portion of the lock of FIG. 1 showing the elements of the solenoid in the de-energized configuration.

Considering the solenoid in more detail (FIGS. 5–7, 9 and 10), the solenoid housing 62 is preferably substantially square in transverse outline (FIGS. 9 and 10) and is movable or slidable in the channel 94. The solenoid housing is closed at the left end and includes a circular hole opening at the top of the housing for holding and guiding a projectable element such as a movable link element in the form of a spherical or curved surface detent 96 which can project, extend or protrude outwardly of the solenoid housing to a detented or engagement position (FIGS. 6 and 7) upon actuation of the solenoid to allow the boss 92 to engage the extended detent and move the solenoid housing from left to right, as viewed in FIGS. 5–7. When the solenoid is not energized and the detent 96 is unextended or withdrawn, the detent 96 is supported below the opening by the shaft of a solenoid plunger 98. The plunger 98 is normally biased to the left (as viewed in FIG. 5) by a spring 100 biasing the plunger from the right end of the plunger. The unenergized configuration of the solenoid is shown in FIG. 5. The left end of the plunger includes a frustoconical section 102 having a sloped surface to allow the spherical detent 96, (upon actuation of the solenoid), to ride up the sloped surface and onto a cylindrical surface 104 at the end of the plunger so that the detent 96 protrudes from the solenoid housing and can then be engaged by the boss 92.

The shaft of the plunger is supported and guided by a spool 106, which in turn is supported by the walls of the solenoid housing. The spool supports a coil 108 which actuates the solenoid plunger when the correct combination code is entered into the printed circuit board and an appropriate signal is produced from an output on the printed circuit board to the coil 108 in the solenoid, as would be known to one skilled in the art. The electrical connection between the output from the printed circuit board and the solenoid coil is conventional and not shown.

An end cap or cup 110 closes the end of the solenoid housing to retain the plunger, spool and coil in place in the solenoid housing. The base of the cup contacting the flanges of the spool 106 supports the plunger spring 100 and stops the rightward travel of the plunger when the solenoid is actuated. The cup includes an interior cavity opening to the right outside end of the solenoid housing for accepting a compression spring 112 for biasing the entire solenoid housing in a direction to the left as viewed in FIGS. 5–7 to position the lever out of engagement with the cam wheel.

A relock 114 (FIGS. 11 and 12) is mounted in and biased outwardly of a cavity in the lock housing 26. The relock is biased outwardly of the cavity by a relock spring 116 for relocking the lever 46 in the disengaged position (as viewed in FIG. 1) by means of a boss 118 on the relock entering the relock recess 50 in the neck of the lever 46. The relock is normally held in the retracted position by the metal retaining plate 64 when the retaining plate, fish paper gasket, printed circuit board, rubber gasket and the cover plate 28 are properly installed. The relock is pushed outwardly by the relock spring 116 to lock the lever in the disengaged position if the metal retaining plate 64 is ever moved, for example, by tampering with the shaft 72.

In operation, the bolt 36 is normally in the locked position, the solenoid is de-energized and the dial, shaft and cam wheel are freely rotatable and axially movable. The cam wheel does not engage significantly either the lever 46 or the solenoid housing 62, and the lever 46 is maintained in a position substantially disengaged from the cam wheel regardless of the rotational position of the cam wheel. The solenoid housing 62 is at its left-most position, and the pin 54 of the lever arm engages the recess 58. The solenoid plunger 98 is also in its left-most position, the solenoid being unenergized, and the detent 96 rests on the plunger shaft below the top edge of the solenoid housing.

By manipulation of the dial 76, the correct combination code can be entered by rotating the cam wheel and moving the cam wheel axially in the proper sequence so that the appropriate pressure pads on the printed circuit board 68 can be actuated by application of pressure through the combination finger 82, as would be understood by one skilled in the art.

Figure 6:
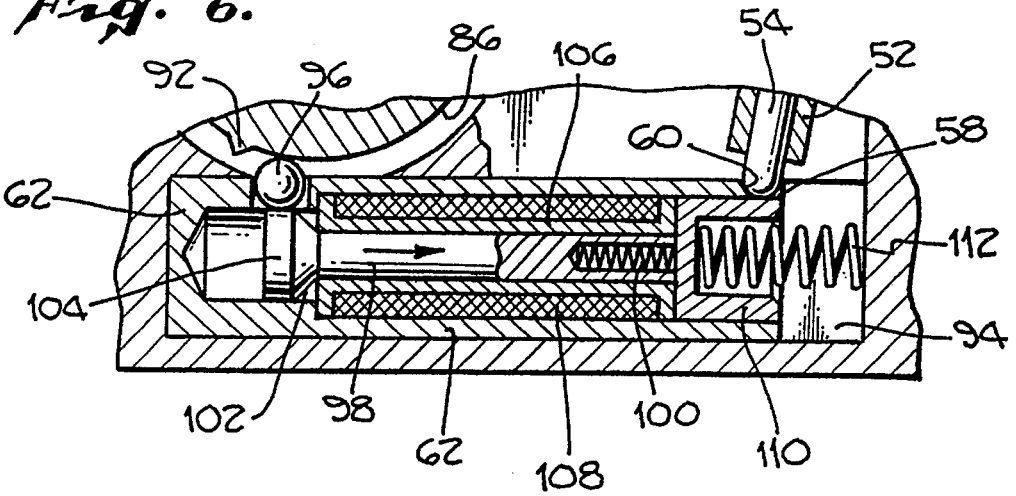
FIG. 6 is a detailed sectional view similar to FIG. 5 of a portion of the lock showing the solenoid energized.
Figure 7:
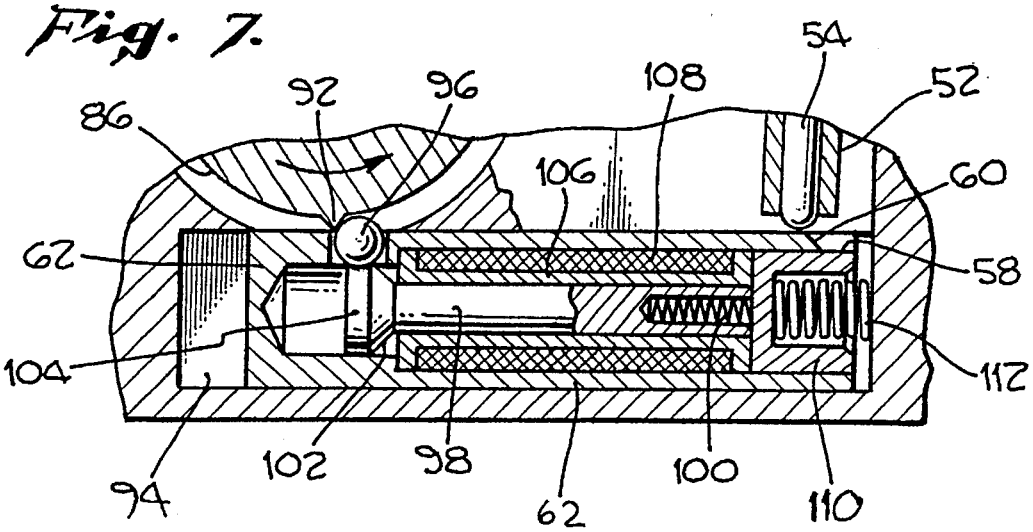
FIG. 7 is a detailed sectional view similar to FIG. 5 of a portion of the lock showing the solenoid energized and shifted to position the lever.

Upon entry of the proper code, a suitable signal is produced at the output of the printed circuit board to the solenoid to actuate and move the plunger 98 to its right-most position. As the solenoid is actuated, the plunger moves to the right under control of the coil 108 so that the spherical detent is then exposed above the top of the solenoid housing 62 so that it can be engaged by the boss 92 on the solenoid cam surface 86 of the cam wheel 47. The condition of the solenoid in the actuated state is shown in FIG. 6. At that point, the cam wheel may be in any rotational position, and the lever is still maintained in its disengaged position. The solenoid housing is also still in its left-most position in the channel 94.

After the solenoid is actuated, the dial can be turned clockwise (counterclockwise as viewed from the back of the lock housing) until the boss 92 engages the spherical detent 96. As the cam wheel continues to rotate, the boss 92 pushes the spherical detent 96 and therefore the solenoid housing along the channel 94 against the bias of spring 112. Movement of the solenoid housing also moves the recess 58 which holds the detent pin 54. The initial movement of the solenoid housing causes the pin 54 in the cantilever arm 52 to move so that the lever pivots until the nose part 48 engages the slot 88 on the cam wheel. The boss 92 on the solenoid cam surface 86 and the slot 88 on the lever cam surface 84 are positioned angularly relative to each other such that the nose part of the lever and the slot 88 are aligned for engagement as the boss 92 pushes the spherical detent 96. After the nose part 48 engages the slot 88, continued translation of .the solenoid housing in the channel 94 causes the pin 54 in the cantilever arm 52 of the lever to ride up the ramp surface 60 and onto the outside of the solenoid housing so that the pin can freely move along the solenoid housing as the bolt is retracted by further rotation of the cam wheel.

Figure 3:
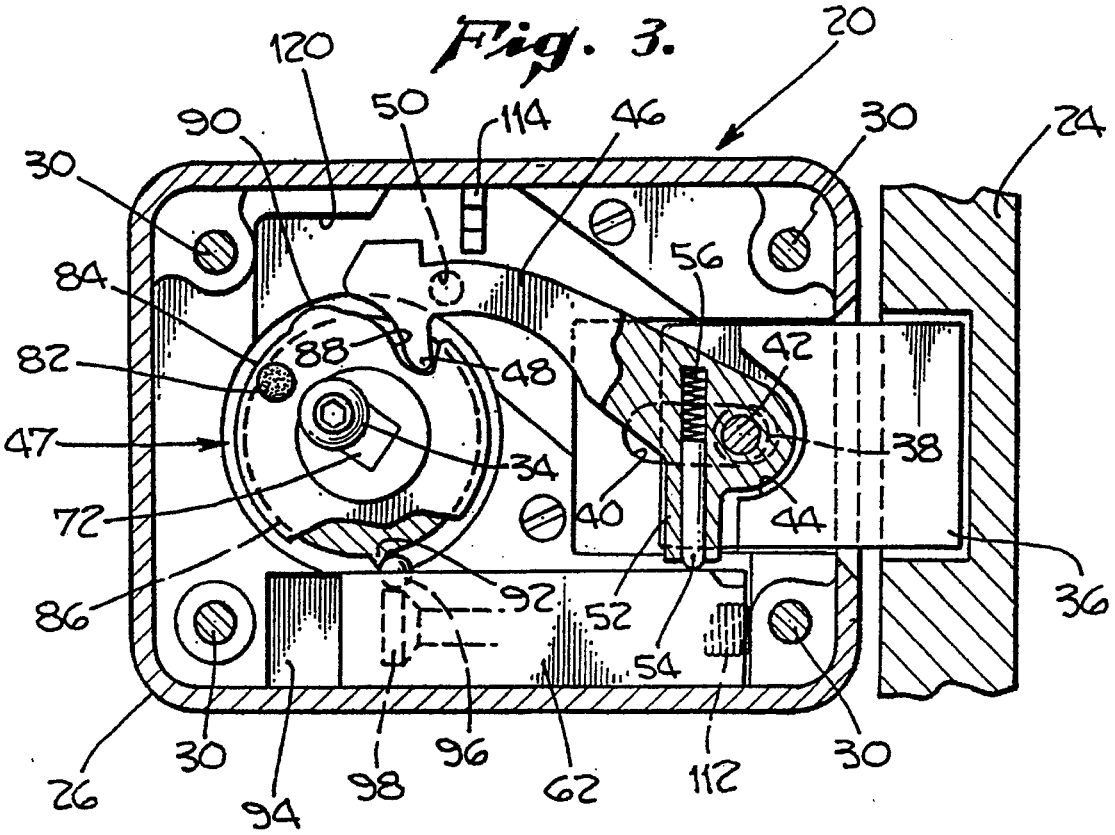
FIG. 3 is a rear sectional view of the lock of FIG. 1 showing activation and the shifted position of a solenoid to engage a lever with a cam wheel slot.

The position of the pin 54 relative to the ramp 60 when the solenoid housing has reached the right-most extent of its travel in the channel 94 is shown in FIG. 3. The lever 46 has fully engaged the gate in the cam wheel 47 such that further rotation of the cam wheel moves the lever longitudinally and so that the bolt 36 can be moved from the locked position shown in FIG. 3 to the unlocked position shown in FIG. 4. Simultaneously, the pin 54 can slide relative to the solenoid housing both as the bolt moves from the locked to the unlocked position and as the solenoid housing returns to its left-most position in the channel 94 as the solenoid becomes de-energized. The door can then be opened.

When the door is thereafter closed and the lock is to be moved back to its locked condition, the dial can be turned in the opposite direction so that the gate pushes the nose part 48 back in the opposite direction to return the bolt to its locked position. Any tendency of the lever to disengage from the gate is prevented by a bearing surface 120 formed in the housing (FIG. 4).

As the cam wheel 47 continues to turn, the lever disengages from the gate and the lever lift cam 90 lifts the end of the lever into the recess in the housing between the bearing surface 120 and the relock 114 (FIG. 1), thereby properly positioning the lever in its disengaged position and the pin 54 in the recess 58. Once the lever 46 has been moved to its disengaged position, the lever lift cam 90 may still touch the nose part 48 of the lever 46 but this possible contact is not considered substantial.

Having described exemplary embodiments of the electronic dial combination lock in accordance with the present invention, it should not be apparent to those skilled in the art that the invention achieves the various objectives and advantages initially disclosed herein. It should also be understood by those skilled in the art that various modifications, adaptations and alternative embodiments of the lock of the present invention may be made within the scope and spirit of the present invention, which is defined by the following claims.

We claim:

1. A method of controlling an electronic lock including a dial, a rotatable cam wheel operably connected to the dial and defining a surface, a locking mechanism movable between a locked position and an unlocked position, and a movable lever operably connected to the locking mechanism and having a protrusion adapted to engage the cam wheel, the method comprising the steps of:

holding the lever in a position where the protrusion cannot contact the surface of the cam wheel and in such a manner that the lever and the dial are operably disconnected and the lever will not move in response to rotation of the dial;

electronically determining whether an input combination corresponds to a predetermined combination;

operably connecting the lever and the dial, while maintaining the lever in a position where the provision cannot contact the surface of the cam wheel in response to a determination that the predetermined combination has been input; and transmitting a force applied to the dial to the lever after the lever and the dial have been operably connected to drive the lever to a position where the protrusion can contact the surface of the cam wheel in such a manner that the lever will be pulled by the cam wheel during rotation of the cam wheel.

2. A method as claimed in claim 1, further comprising the step of:

further rotating the dial after the lever has been moved to the position where the protrusion can contact the cam wheel in such a manner that the lever will be pulled by the cam wheel during rotation of the cam wheel to cause the cam wheel to engage the protrusion and pull the locking mechanism to the unlocked position.

3. A method as claimed in claim 1, wherein the step of electronically determining whether an input combination corresponds to a predetermined combination comprises the step of monitoring a combination input through rotation of the dial.

4. An electronic combination lock to allow selective access to a closed or secured location, the lock comprising:

a rotatable dial;

a locking mechanism for operating between a locked condition and an unlocked condition;

a rotatable cam wheel, operably connected to the dial, having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position where said protrusion is spaced apart from the cam wheel and independent of rotational movement of the cam wheel; and a substantially non-resilient lever moving element, generally inoperable prior to an entry of a correct combination and actuated in response to an entry of the correct combination, for moving the lever in response to further rotation of the dial after the entry of the correct combination from its stationary position towards said cam wheel and to a position for engaging the protrusion of the lever with the cam surface on the cam wheel so that rotation of the cam wheel thereafter in the given direction changes the locking mechanism from the locked condition to the unlocked condition.

5. The lock of claim 4 wherein the locking mechanism includes a bolt to which the lever is pivotally coupled such that longitudinal movement of the engaged lever upon rotation of the cam wheel moves the bolt from a locked position to an unlocked position.

6. The lock of claim 4 further comprising:

a housing containing the cam wheel and having a wall;

a shaft journaled through the wall of the housing and into the cam wheel such that rotation of the shaft rotates the earn wheel, the dial being mounted to the shaft for selecting a combination code; and electronic means for recording the combination code being entered in order to unlock the lock wherein the combination code is entered into said electronic means through a sequence of rotational and axial movements of the dial.

7. The lock of claim 6 wherein the cam wheel further includes means for moving the lever moving element upon rotation of the cam wheel when the correct combination has been entered and said lever moving element is electronically activated to cooperate with said moving means when said combination has been entered.

8. The lock of claim 7 wherein the lever moving element includes a projectable element which protrudes from the lever moving element upon electronic activation of the lever moving element and wherein the means for moving the lever moving element includes a protrusion on the cam wheel for bearing against the projectable element.

9. The lock of claim 4 wherein the releasable means for maintaining the movable lever includes:

a movable recessed surface; and an element extending from the lever to the movable recessed surface such that movement of the recessed surface moves the lever.

10. The lock of claim 9 wherein the element includes a spring biased pin extending from a cantilevered portion of the lever and the moveable recessed surface defines a recess for accepting and retaining a head of the biased pin when the lever is maintained in the disengaged position.

11. The lock of claim 10 wherein the locking mechanism includes a bolt to which the lever is pivotably coupled through a pivot pin such that longitudinal movement of the engaged lever upon rotation of the cam wheel moves the bolt from a locked position to an unlocked position and the spring biased pin is not colinear with the pivot pin.

12. The lock of claim 11 wherein the movable recessed surface further defines a ramp so that the head of the biased pin can travel along the ramp and out of the recess.

13. The lock of claim 12 wherein:

the lever moving element includes a projectable element;

the cam wheel includes a protrusion for engaging the projectable element;

the lever moving element further includes a second rigid element extending between the cam wheel and movable surface for moving the movable surface when the cam wheel rotates; and the cam wheel protrusion engages the projectable element on the lever moving element.

14. The lock of claim 4 wherein the releasable means includes a projection on the movable lever for engaging the lever moving element such that movement of the lever moving element moves the projection on the lever to move the lever.

15. The lock of claim 14 wherein the lever moving element is biased in a direction for holding the lever disengaged from the cam wheel.

16. The lock of claim 15 wherein the lever moving element is substantially disengaged from the cam wheel during normal operation and further includes a projectable element movable to a position for contact with the cam wheel upon entry of a combination.

17. The lock of claim 4 wherein the lever moving element includes:

a solenoid; and a detent activated by the solenoid to protrude from the lever moving element upon electronic activation of the solenoid.

18. The lock of claim 17 further comprising means for moving the lever moving element including a protrusion from a circumferential surface portion on the cam wheel for bearing against the detent.

19. The lock of claim 18 wherein the lever moving element further includes a solenoid assembly having a solenoid housing enclosing a plunger normally biased such that the solenoid detent is recessed and wherein activation of the solenoid causes the solenoid detent to protrude from the housing.

20. The lock of claim 19 wherein the releasable means for maintaining the moveable lever includes a spring biased detent extending from the lever to engage a recessed ramp surface integral with the solenoid housing such that the spring biased detent is held in the recess and the lever is disengaged from the cam wheel when the solenoid is not activated.

21. The lock of claim 20 further comprising a lock housing containing the cam wheel and the solenoid assembly and wherein the solenoid housing extends between the solenoid detent and the ramp surface, wherein the solenoid housing includes a spring for biasing the solenoid housing such that the spring biased detent rests in the recess when the lock combination has not been entered and wherein activation of the solenoid and rotation of the cam wheel moves the solenoid housing so that the lever is moved into engagement with the cam wheel and the spring biased detent moves along the ramp and out of the recess.

22. An electronic combination lock to allow selective access to a closed or secured location, the lock comprising:

a rotatable dial;

a locking mechanism for operating between a locked condition and an unlocked condition;

a rotatable cam wheel, operably connected to the dial, having an engaging element and a cam surface such that rotation of the cam wheel in a given direction moves the cam surface in an are;

a movable lever coupled to the locking mechanism for changing the condition of the locking mechanism from the locked condition to the unlocked condition, pivotably movable into and out of engagement with the cam wheel, and including a protrusion for engaging the cam surface in the cam wheel such that when the protrusion engages the cam surface rotation of the cam wheel maintains engagement of the cam wheel with the lever which changes the condition of the locking mechanism; and a lever controlling device, disengaged from the cam wheel engaging element before entry of a correct combination and engaged by the cam wheel engaging element in response to an entry of the correct combination, for maintaining the movable lever in a substantially stationary position where said protrusion is spaced apart from the cam wheel and independent of any rotational movement of the cam wheel and for moving the lever from its stationary position towards said cam wheel to a position for engaging the protrusion on the lever with the cam surface on the cam wheel in response to further rotation of the dial after the entry of the correct combination and engagement of the lever controlling device by the cam wheel engaging element so that rotation of the cam wheel in the given direction after engagement of the protrusion with the cam surface changes the locking mechanism from the locked condition to the unlocked condition.

23. The lock of claim 22 wherein:

the locking mechanism includes a bolt;

the protrusion is defined by a nose part;

the cam surface in the rotatable cam wheel is configured for accepting the nose part on the movable lever; and the movable lever is pivotably coupled to the bolt through a pin.

24. The lock of claim 23 wherein the lever controlling device includes a cantilever portion extending from the lever having a spring biased detent for engaging a recess to maintain the pivotable lever in a disengaged position.

25. The lock of claim 24 wherein the lever controlling device includes an element extending between the cam wheel and the recess for the spring biased detent such that movement of the element moves the pivotable lever into engagement with the cam wheel.

26. The lock of claim 25 wherein the lever controlling device further includes a solenoid actuated detent for engagement with a protruding circumferential surface portion on the cam wheel so that rotation of the cam wheel and engagement of the protruding circumferential surface portion on said cam wheel with the solenoid actuated detent moves the lever into engagement with the cam surface on the cam wheel.

27. The lock of claim 26 wherein the recess includes a surface defining a ramp such that the spring biased detent may travel up the ramp and out of the recess.

28. The lock of claim 22 further comprising:

a lock housing for enclosing the lever and the cam wheel;

a retaining plate in said housing generally adjacent said cam wheel and a recess in the lock housing spaced from said plate; and a relock member wherein the lever includes an opening for accepting a portion of the relock member and wherein the relock member is biased outwardly of the recess toward the lever and is maintained in the recess against such bias by the retaining plate such that the relock member engages the lever when the retaining plate is moved.

29. The lock of claim 22 wherein the lever controlling device includes a projectable element out of contact with the cam wheel before entry of a combination to open the lock and projectable toward the cam wheel so that the rotation of the cam wheel contacts the projectable element to move the lever for engaging the protrusion on the lever with the cam surface on the cam wheel.

30. The lock of claim 29 further comprising an electromechanical device actuated after entry of the combination for projecting the projectable element toward the cam wheel after entry of the combination.

31. The lock of claim 22 wherein the lever controlling device is biased in a direction for holding the lever disengaged from the cam wheel.

32. The lock of claim 31 wherein the lever controlling device is substantially disengaged from the cam wheel during normal operation before entry of a combination and further includes a projectable element movable to a position for contact with the cam wheel upon entry of a combination.

33. The lock of claim 31 wherein the lever controlling device includes a recessed surface for receiving a portion of the lever such that movement of the recessed surface with the lever controlling device moves the lever for engaging the protrusion on the lever with the cam surface on the cam wheel.

34. In an electronically operated lock having a dial and a bolt operating lever manipulated by engagement with a dial operated cam when a predetermined combination has been entered via said dial, said lever including a protrusion for engaging a surface of said cam, the improvement comprising the provision of:

lever retaining means for normally holding said lever in a position where said protrusion is spaced apart from said cam surface and maintaining said lever in said position during rotation of said dial until after said combination has been entered; and lever operating means, including a rigid element separate from the lever and out of contact with the cam before entry of said combination and engaged by the cam in response to an entry of said combination, for positively driving said lever toward said cam in response to continued dial rotation after said combination has been entered and the rigid element has been engaged by the cam, whereby said lock is unlocked by rotation of said dial after entry of said combination and said lever is positively manipulated through the rigid element by dial rotation to engage said dial operated cam only after entry of said combination.

35. The lock of claim 34 wherein:

said lock includes a solenoid electronically actuated by entry of the predetermined combination;

said lever retaining means includes a lever movement blocking element; and said lever operating means includes:

a detent operable by said solenoid to a detented position and associated with said blocking element; and a detent engagement member on said cam whereby operation of said solenoid by entry of said combination moves said detent to said detented position wherein rotation of said dial operated cam drives said member against said detent to move said lever into engagement with said cam.

36. The lock of claim 34 wherein:

the cam includes a protruding circumferential surface portion; and the rigid element separate from the lever includes a shaft having a first end adjacent the cam such that the protruding circumferential surface portion passes adjacent the first end upon rotation of the cam and a second end adjacent the lever such that upon entry of said combination, the protruding circumferential surface portion moves the first end of the shaft to move the shaft and the lever to engage the dial operated cam only after entry of the combination.

37. The lock of claim 34 wherein the lever retaining means includes a projection on the lever for engaging the lever operating means such that movement of the lever operating means moves the projection on the lever to move the lever.

38. The lock of claim 34 wherein the lever operating means includes a recessed surface for receiving a portion of the lever such that movement of the recessed surface with the lever operating means moves the lever for engaging the protrusion on the lever with the cam.

39. An electronic lock, comprising:

a dial;

a rotatable cam wheel operably connected to the dial and defining a cam surface and a first engaging element;

an electronic device for determining whether a combination input through manipulation of the dial corresponds to a predetermined combination and for generating a signal when the predetermined combination has been input;

a locking mechanism movable between a locked position and an unlocked position;

a movable lever operably connected to the locking mechanism and including a protrusion adapted to engage the cam wheel;

a lever holding element, including a second engaging element, operably connected to the lever, the lever holding element being movable between a first position where the lever is held such that the protrusion is spaced apart from and cannot engage the cam surface and a second position where the lever is held such that the protrusion engages the cam surface, the lever holding element being biased to the first position; and an actuator operably connected to the lever holding element and to the electronic device, the actuator moving at least one of the first and second engaging elements into an orientation where the first and second engaging elements can engage one another in response to a reception of the signal from the electronic device such that rotation of the dial after the engaging elements engage one another causes the lever holding element to move to the second position.

40. An electronic lock as claimed in claim 39 wherein the first engaging element comprises a detent enagaging boss the second engaging element comprises a movable detent, the actuator comprises a solenoid, and the lever holding element further includes a movable solenoid housing and an arm attached to the lever.

41. An electronic lock as claimed in claim 39 wherein the lever holding element is biased by a spring.

* * * * *